US009464869B1

(12) United States Patent
LoRocco et al.

(10) Patent No.: US 9,464,869 B1
(45) Date of Patent: Oct. 11, 2016

(54) ARCHERY BOWSIGHT WITH HYBRID SUPPORT BRACKET

(71) Applicant: TruGlo, Inc., Richardson, TX (US)

(72) Inventors: Paul LoRocco, Dallas, TX (US); John Estridge, Garland, TX (US); Alvin R. Wirthlin, Frisco, TX (US)

(73) Assignee: TruGlo, Inc., Richardson, TX (US)

( * ) Notice: Subject to any disclaimer, the term of this patent is extended or adjusted under 35 U.S.C. 154(b) by 144 days.

(21) Appl. No.: 14/605,227

(22) Filed: Jan. 26, 2015

Related U.S. Application Data

(60) Provisional application No. 61/931,050, filed on Jan. 24, 2014.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87, 88
See application file for complete search history.

(56) References Cited

U.S. PATENT DOCUMENTS 6,301,817 B1 10/2001 Hogue et al.
7,574,810 B1 * 8/2009 LoRocco ..... F41G 1/30 124/87
8,062,736 B1 11/2011 Coolong et al.
8,839,774 B1 * 9/2014 Torbett ..... F41B 5/1453 124/88
2002/0073560 A1 * 6/2002 LoRocco ..... F41G 1/467 33/265
2006/0254065 A1 * 11/2006 Grace ..... F41G 1/467 33/265
2008/0010841 A1 * 1/2008 Gordon ..... F41G 1/467 33/265
2012/0138035 A1 6/2012 Ellig
2013/0242593 A1 * 9/2013 LoRocco ..... F41G 1/345 362/551
2015/0082643 A1 * 3/2015 Summers ..... F41G 1/467 33/265
2015/0135579 A1 * 5/2015 Summers ..... F41G 1/467 42/130
2016/0025456 A1 * 1/2016 Hamm ..... F41G 1/467 33/265

* cited by examiner

*Primary Examiner* — G. Bradley Bennett
(74) *Attorney, Agent, or Firm* — Alvin R. Wirthlin

(57) ABSTRACT

A hybrid bracket assembly for mounting an archery sight or other accessory to an archery bow includes a core and a frame. The core has a plate constructed of a material having a first stiffness. The plate has a first side, an opposing second side, and a peripheral edge located between the first and second sides, and at least one set of mounting holes extending through a thickness of the plate for mounting the hybrid bracket assembly to the archery bow. The frame includes a moldable material with a second stiffness less than the first stiffness. The moldable material extends around at least a segment of the peripheral edge and overlaps an area of the first and second sides of the plate.

20 Claims, 5 Drawing Sheets

ARCHERY BOWSIGHT WITH HYBRID SUPPORT BRACKET

CROSS-REFERENCE TO RELATED APPLICATIONS

This application claims the benefit of U.S. Provisional Application No. 61/931,050 filed on Jan. 24, 2014, the disclosure of which is hereby incorporated by reference.

BACKGROUND OF THE INVENTION

This invention relates generally to the field of archery, and more particularly to an archery sight and a support bracket for mounting the sight to a bow.

The typical support bracket for archery sights is constructed either completely of metal or completely of plastic. On one hand, metal brackets have the advantage of being stronger and thinner than their plastic counterparts, and can be constructed more precisely with fewer problems during manufacture, but suffer from excessive weight, which can affect user performance, especially when aiming for prolonged periods of time, such as in the field when the user is waiting for the precise location and position of the game being hunted.

On the other hand, plastic support brackets, although generally lighter in weight than their metal counterparts, suffer from undesired thickness, torsional forces during aiming and shooting, as well as warpage and other problems during the manufacturing process, which may render the bracket unsuitable for use, or when used may become deformed, thus leading to aiming inaccuracies. Warpage and other problems during the manufacturing process may also generate waste as molded parts are rejected and ultimately increase the cost of the bowsight.

In the highly competitive field of archery equipment and accessories, reducing cost and weight while improving strength, durability, and accuracy are of major importance. It would therefore be desirous to provide a bracket for an archery sight that overcomes one or more disadvantages of the prior art.

SUMMARY OF THE INVENTION

In accordance with one aspect of the invention, a hybrid bracket assembly for mounting an accessory to an archery bow, such as an archery sight, includes a core having a plurality of first holes for mounting the hybrid bracket to a riser of a bow, and a frame surrounding at least a portion of an outer peripheral edge of the core and overlapping an area of the core coincident with the plurality of first holes. The frame has a plurality of corresponding second holes that are coincident with the first holes. The core and frame have different material properties.

In accordance with a further aspect of the invention, a hybrid bracket assembly for mounting an accessory to an archery bow, such as an archery sight, includes a core and a frame. The core has a plate constructed of a material having a first stiffness. The plate has a first side, an opposing second side, and a peripheral edge located between the first and second sides, and at least one set of mounting holes extending through a thickness of the plate for mounting the hybrid bracket assembly to the archery bow. The frame includes a moldable material with a second stiffness less than the first stiffness. The moldable material extends around at least a segment of the peripheral edge and overlaps an area of the first and second sides of the plate.

In accordance with yet a further aspect of the invention, a bowsight includes the hybrid bracket assembly first described above, and further comprises a sight assembly having at least one sight pin for aligning with a distal target by a user during aiming, and an adjustment member connected to the sight assembly and the hybrid bracket assembly. The adjustment member and sight assembly have first cooperating structure for selectively adjusting an elevation position of the sight assembly with respect to the hybrid bracket assembly. Likewise, the adjustment member and the hybrid bracket assembly have second cooperating structure for selectively adjusting a windage position of the sight assembly with respect to the hybrid bracket assembly.

In accordance with yet another aspect of the invention, a method of forming a hybrid bracket assembly for mounting an archery accessory to an archery bow comprises providing a core with a first material having a first stiffness; forming a first set of openings in the core for mounting the hybrid bracket to a riser of a bow; forming at least one retaining aperture in the core; forming a frame around at least a portion of a peripheral edge of the core, the frame having a second material with a second stiffness lower than the first stiffness; and extruding material from the frame into the at least one retaining aperture while forming the frame to thereby create at least one retaining bump in the frame so that the core and the frame function as an integral structure.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

Figure 1:
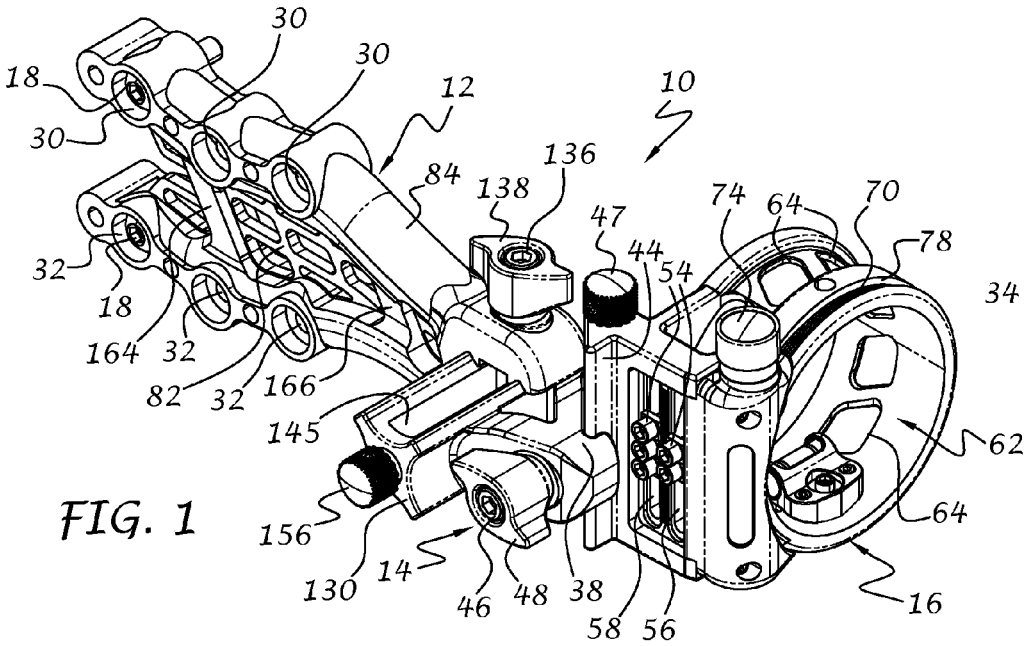
FIG. 1 is a front right isometric view of an archery bowsight in accordance with the invention.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Referring now to the drawings, and to FIGS. 1-4 in particular, a bowsight 10 in accordance with the present invention is illustrated. The bowsight 10 preferably includes a hybrid bracket assembly 12, an adjustment member 14 connected to the hybrid bracket assembly 12, and a sight assembly 16 connected to the adjustment member 14. The bracket assembly 12 is useful for attaching the bowsight 10 to an archery bow (not shown) or the like via threaded fasteners 18 that extend through a selected pair of upper mounting holes 30 aligned with lower mounting holes 32 formed in the bracket assembly 12 and thread into the bow structure (not shown) in a conventional manner. The separate pairs of aligned upper and lower mounting holes ensure that a wide variety of bow mounting requirements can be met. Although the present invention is primarily adapted for use with compound bows or the like, it will be understood that the bowsight 10 and/or the hybrid bracket assembly 12 can be used with other types of archery bows, such as longbows, recurve bows, crossbows, and so on, without departing from the spirit and scope of the invention.

The sight assembly 16 preferably includes a frame 34 connected to the adjustment member 14 and a sight portion 36 connected to the frame 34. The adjustment member 14 preferably includes an outer jaw portion 38 and an adjustable inner jaw portion 40 with a dovetail-like groove 42 formed therebetween that is shaped to receive a complementary dovetail-like projection 44 of the frame 34. A bolt 46 (FIG. 2) extends through an elevation knob 48, through an opening in the outer jaw portion 38, through a vertical slot 45 (FIGS. 2, 4) formed in the dovetail projection 44, and into a threaded opening of the inner jaw portion 40. Preferably, rotation of the bolt 46 in a clockwise direction draws the inner jaw portion toward the outer jaw portion to close the dovetail-like groove 42 around the dovetail projection 44 so that the sight assembly 16 is vertically adjusted to a desired position with respect to the adjustment member 14. Conversely, rotation of the bolt in a counter-clockwise direction causes the inner jaw portion 40 to move away from the outer jaw portion 38, thus expanding the dovetail-like groove 42 around the dovetail-like protection 44 to permit slidable vertical adjustment of the sight assembly 16 along the dovetail slot 42 and projection 44 with respect to the base 14, and thus with respect to the hybrid bracket assembly 12.

A threaded micro-adjustment rod 49 (FIG. 4) extends from a vertical micro-adjustment knob 47, along the slot 45, and through a traverse threaded aperture (not shown) in the inner jaw portion 40. When the knob 47 is rotated in one direction, the rod (not shown) causes the inner jaw portion 40 to move along the slot 45 in a first direction, while rotation of the knob 47 in the opposite direction causes the inner jaw portion to slide along the slot 45 in the opposite direction, to thereby precisely adjust a vertical or elevation position of the sight assembly 16 with respect to the hybrid bracket assembly 12. In this manner, elevation adjustment of the entire sight assembly is provided with both macro- and micro-adjustment features. A height scale (not shown) can be positioned on the frame 34 for displaying the relative position between the sight assembly 16 and the adjustment member 14. Elevation adjustment of the entire sight assembly 16 may be needed, for example, when initially calibrating the sighting device 10 with a particular bow, when changing from one type of arrow to another, when shooting from different heights, such as from the ground or from a tree stand, and so on.

The sight portion 36 preferably includes one or more alternating sight pin assemblies 50, 52 (FIGS. 2 and 4) connected to the frame 34 with bolts 54 (FIGS. 1 and 3) that extend through vertically extending slots 56, 58 formed in a side wall 60 of the frame 34 and into threaded openings (not shown) of each alternating pin assembly 50, 52. In this manner, each pin assembly 50, 52 is independently adjustable in a vertical direction to accommodate a particular bow strength and arrow type for different yardages or distances to a target.

The frame 34 preferably has an annular wall 60 that forms a sight window 62 through which the sight assembly 16 and a distal target can be viewed by a user. Preferably, the sight assembly 16 is mounted to the sight frame within the sight window 62. A plurality of openings 64 can be provided in the annular wall 60 to reduce the weight of the sighting device 10, while advantageously allowing the passage of radial light therethrough for naturally illuminating the sight assembly 16.

Figure 2:
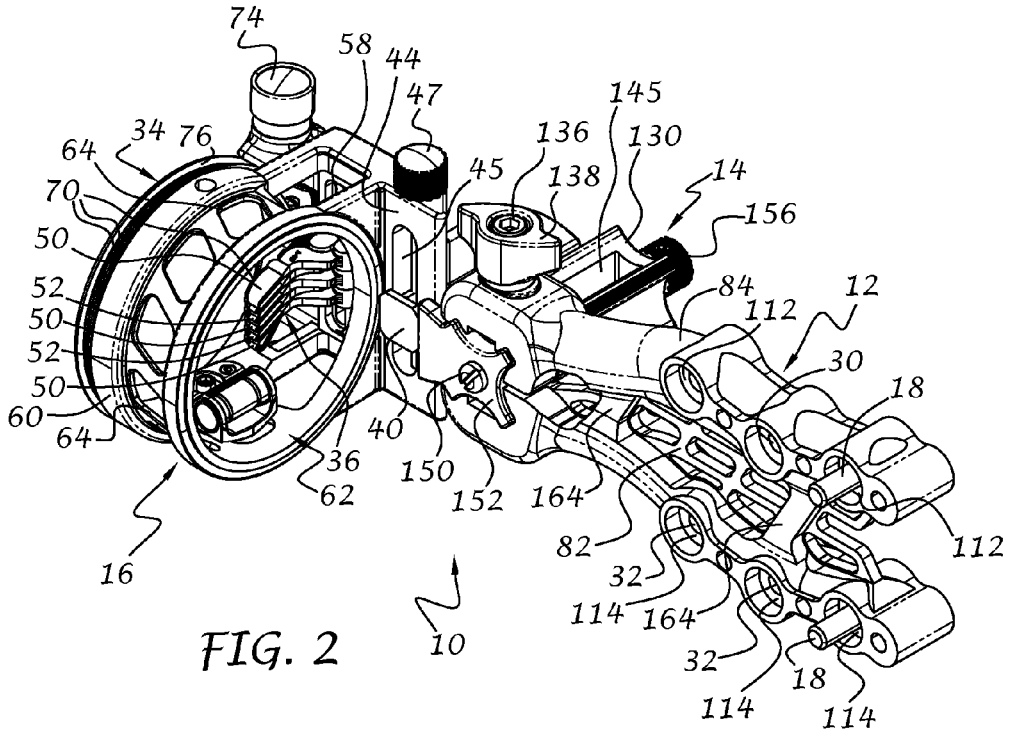
FIG. 2 is a rear left isometric view thereof.
Figure 4:
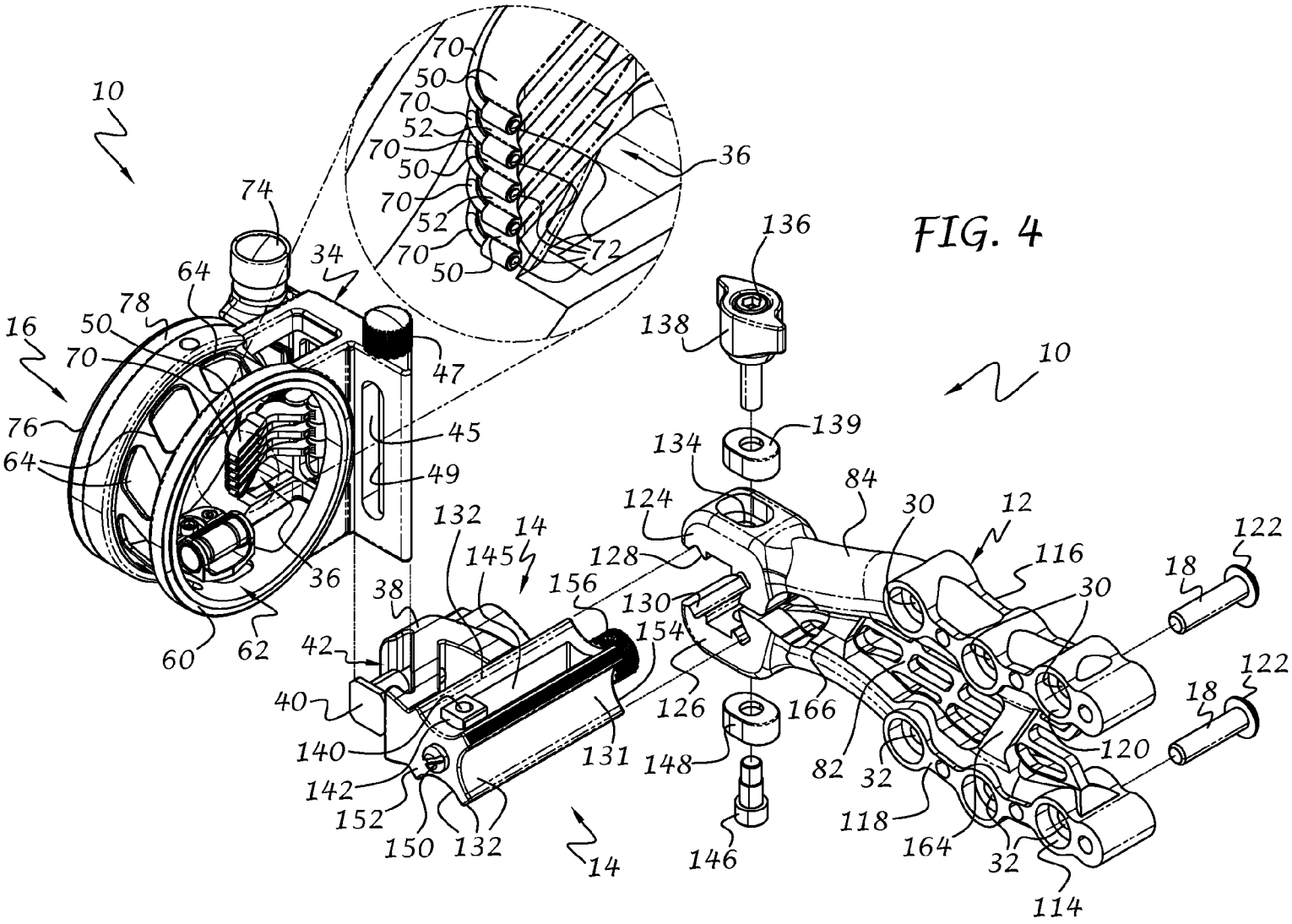
FIG. 4 is a partially exploded rear left isometric view thereof.

As best shown in FIGS. 2 and 4, the sight pin assemblies 50, 52 are vertically oriented to demark different target distances. For example, the top pin assembly 50 can be used to demark a target at 25 yards, the next pin assembly 52 can be used to demark a target at 50 yards, and so on. Although five separate pin assemblies 50, 52 are shown in a stacked and aligned configuration, it will be understood that more or less pin assemblies may be provided in any configuration without departing from the broad aspects of the invention.

The sight pin assemblies 50, 52 are identical in construction with the exception of the location of the threaded opening (not shown) into which the bolts 54 thread. For example, the threaded opening of one sight pin assembly 50 can be aligned with the slot 56, while the threaded opening of another sight pin 52 can be aligned with the slot 58. Accordingly, each sight pin 50, 52 preferably includes a light collector 70, preferably in the form of a fluorescent-doped optical fiber or the like. Each light collector 70 has a length of optical fiber terminating at a sight point or dot 72 coincident with an inner free end of its associated sight pin 50 or 52. The sight point or dot 72 can be naturally illuminated by collecting ambient light along the length of the light collector and/or artificially illuminated with a battery-powered light assembly 74. The light assembly 74 is of conventional construction and includes a LED or the like (not shown) that is selectively energized by the user to project radiant energy either along the lengths of the light collectors 70 or into opposite ends thereof to artificially illuminate the sight points 72. Each light collector 70 extends along a forward edge of its associated sight pin 50 or 52 out of sight of the user during aiming. The light collectors are wrapped around the annular wall 60 within a circular channel 76 formed in the annular wall at a position forwardly of the sight points, i.e. a position closer to the target than the sight points, and surrounds the sight window 62. A transparent cover 78 (FIGS. 3 and 4) is positioned over the strands of light collectors to protect them from the environment while allowing the passage of ambient light.

Each light collector 70 preferably comprises an optical fiber constructed of a fluorescent-doped core with a transparent outer cladding. A suitable fluorescent-doped optical fiber may be constructed of a polystyrene-based or polymethyl methacrylate core containing one or more fluorescent dopants surrounded by a polystyrene, polymethyl methacrylate, or fluoropolymer cladding. When such an optical fiber receives radiation along its length, energy is absorbed in the optical fiber at a certain wavelength and is re-emitted at both ends of the optical fiber at a longer wavelength. Thus, depending on the amount of radiation absorbed by the optical fiber along its length, a proportionate amount of radiation is emitted at the ends of the optical fiber. In use, light incident on the portions of the light collectors is absorbed in the fluorescent-doped optical fibers and is re-emitted at their proximal and distal ends. Light emitted from the distal ends 72 of the optical fibers 70 serve as separate illuminated sight dots or points that are adjustable for different distances to a target for a particular bow and arrow or the like. Further details of a suitable pin assembly can be found for example in U.S. Provisional Application No. 62/009,638 filed on Jun. 9, 2014, the disclosure of which is hereby incorporated by reference. Although a particular sight assembly has been shown and described, it will be understood that the hybrid sight bracket 12 can be used with a different sight assembly or with different archery accessories of any desired type and configuration without departing from the broader aspects of the invention.

Figure 5:
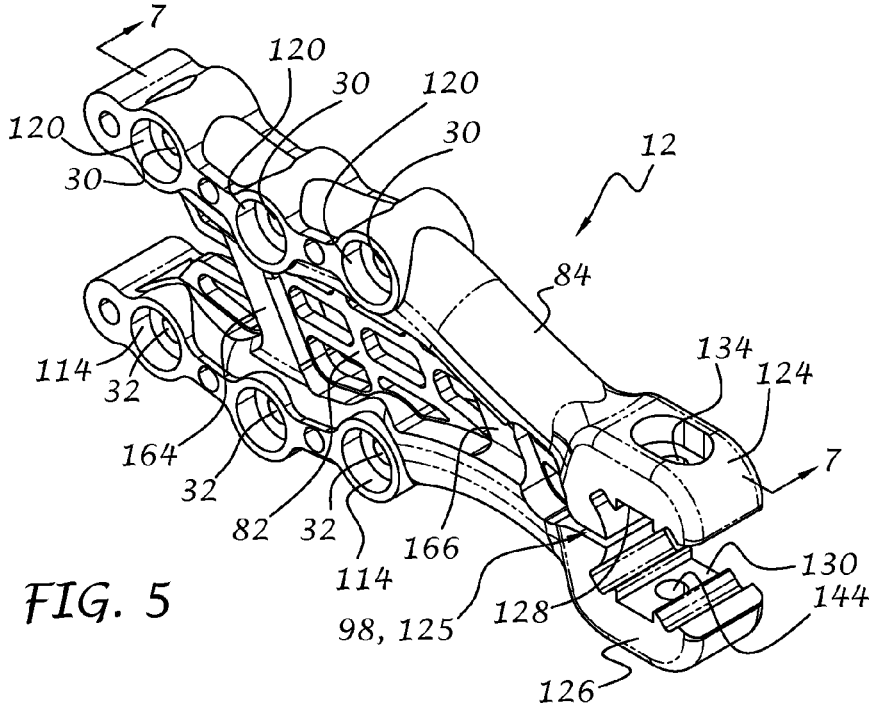
FIG. 5 is a front right isometric view of a hybrid bracket assembly in accordance with an exemplary embodiment of the invention for use with an archery bowsight.
Figure 6:
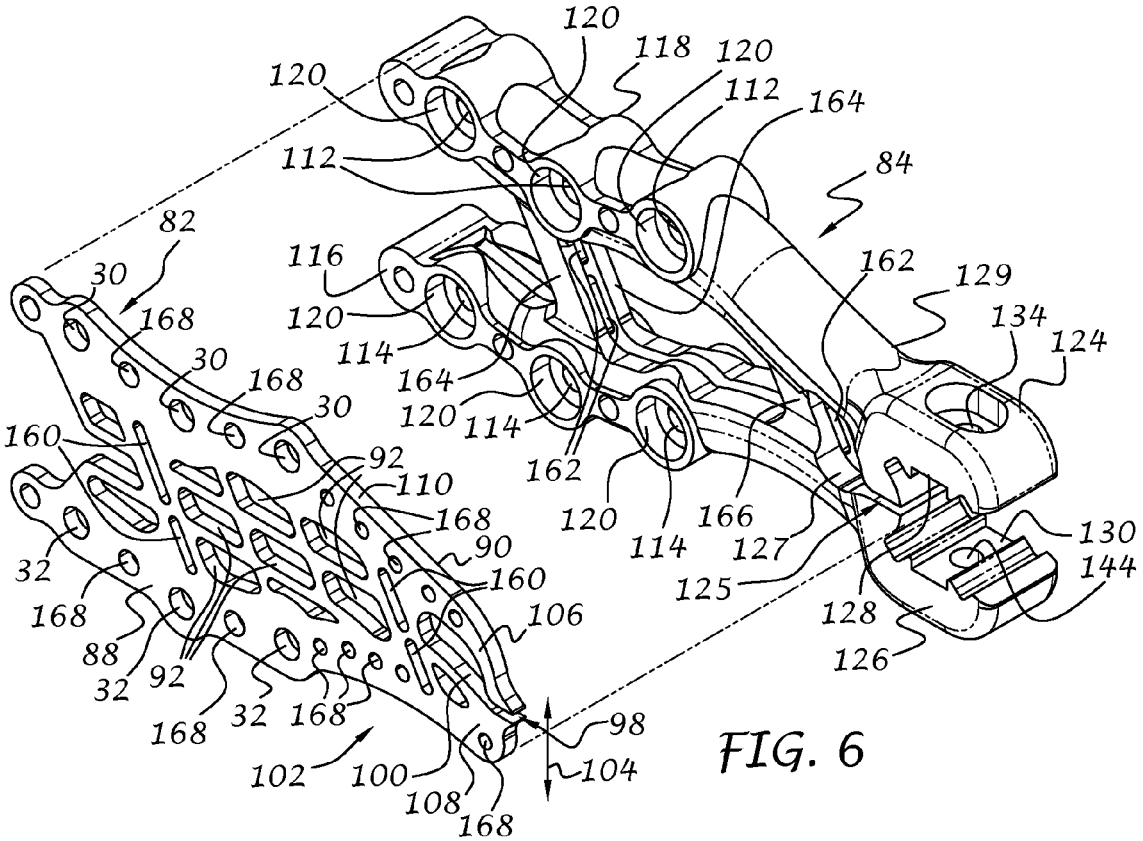
FIG. 6 is an exploded front right isometric view thereof.
Figure 7:
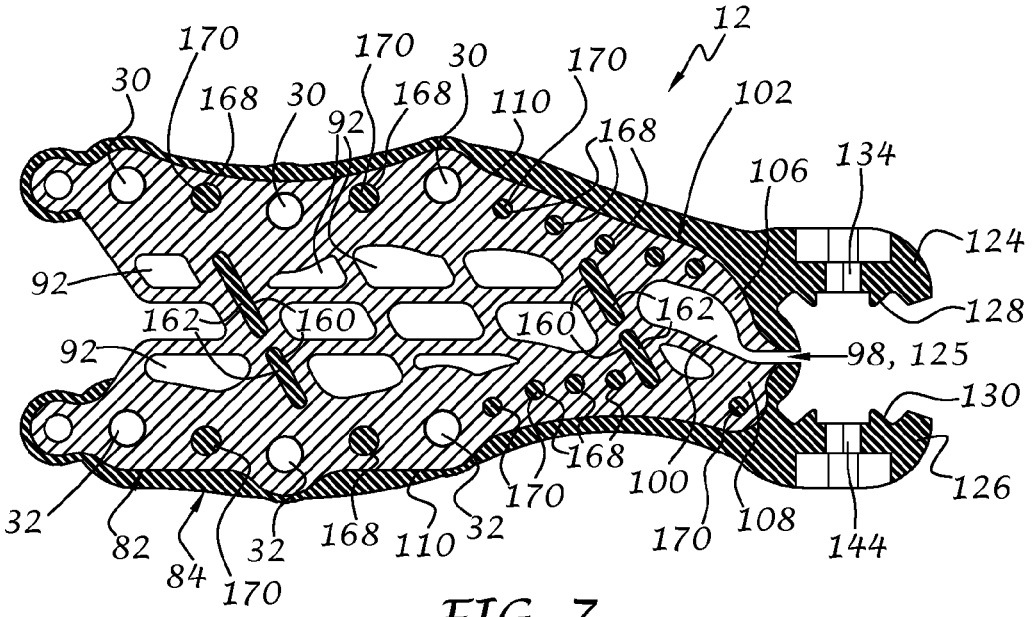
FIG. 7 is a longitudinal sectional view thereof taken along line 7-7 of FIG. 5.

With particular reference to FIGS. 5-7, the hybrid bracket assembly 12 in accordance with the invention is illustrated. The bracket assembly 12 includes a core 82 securely connected to a frame 84. The core 82 preferably comprises a plate structure 86 and can be constructed of metal material such as, but not limited to, aluminum, magnesium, titanium or similar metals with advanced mechanical properties such as high strength and low weight. When formed of a metal material, the core 82 can be formed by die casting, stamping, squeeze casting, forging, Metal Injection Molding (MIM) or other known forming means. Ceramics, plastics, thermoplastics, and composite materials can alternatively and/or additionally be used and formed through casting, machining, molding, or other known forming means without departing from the spirit and scope of the invention. The core 82 can also be of any color or combinations of colors.

As shown in FIGS. 6 and 7, separate pairs of upper mounting holes 30 and their associated aligned lower mounting holes 32, as previously described, are formed in the plate structure 86 of the core 82 and extend between an outer face 88 and opposing inner face 90 of the plate structure. The mounting holes 30, 34 are sufficiently sized for slidably receiving the threaded fasteners 18 to connect the hybrid bracket assembly 12, and thus the bowsight 10 or other accessory, to the riser of a bow (not shown) or other structure. A plurality of openings 92 of various sizes and shapes can be formed in the core 82 to reduce the weight of the core and lower material costs without compromising strength or integrity. To that end, the openings 92 can be arranged to form an aesthetically pleasing design, such as shown in FIG. 7, wherein one or more openings 92, in accordance with an exemplary embodiment of the invention, form a generally grid- or grating-like pattern or structure.

Figure 8:
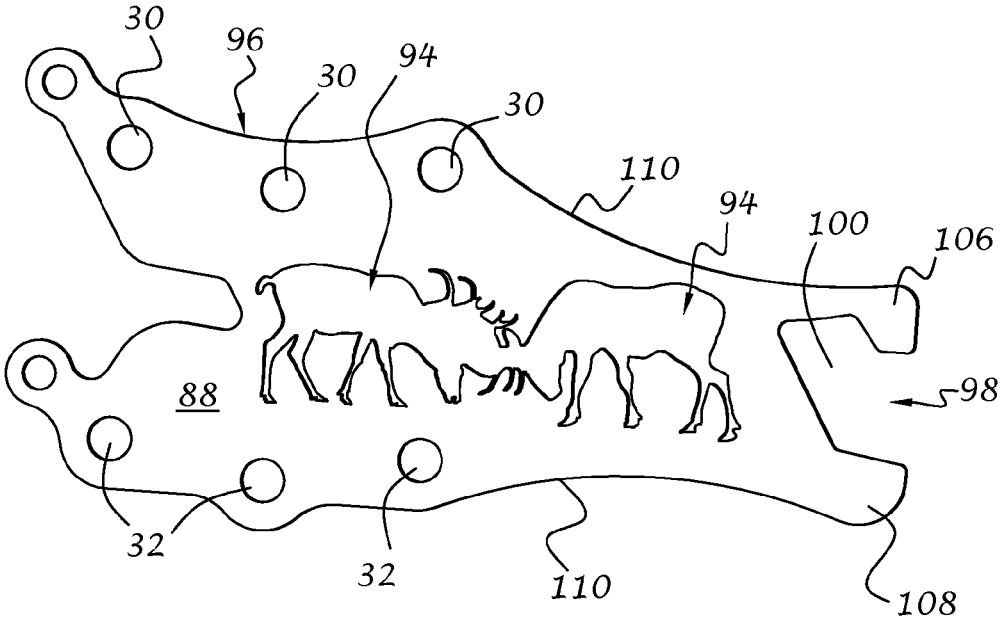
FIG. 8 is a side elevational view of a core portion of the hybrid bracket assembly in accordance with a further exemplary embodiment of the invention.

Likewise, as shown in FIG. 8, one or more openings 94 of a core 96, in accordance with a further exemplary embodiment of the invention, can depict one or more wildlife shapes, landscape scenery, as well as combinations thereof and/or other shapes or designs that are aesthetically pleasing to a potential purchaser or user while providing structural support to the hybrid bracket assembly 12. Accordingly, it will be understood that the size, shape, and number of openings can greatly vary without departing from the spirit and scope of the invention. Moreover, it will be understood that the openings may be eliminated to produce a solid core.

As best shown in FIG. 7, an adjustment slot 98 and an adjustment hole 100 are formed in the core 82 at a forward connection end 102 thereof. The slot 98 and hole 100 intersect with each other so that the forward connecting end of the core 82 has some flexibility in opposing directions, as denoted by arrow 104, to thereby allow movement of a pair of core jaws, as denoted by a core upper jaw section 106 and an opposing core lower jaw section 108, located at the connection end 102, toward and away from each other, such as when the adjustment member 14 is moved with respect to the hybrid bracket assembly 12 when gang adjusting the windage position of the sight assembly 16, as will be described in further detail below.

Referring now to FIGS. 6 and 7, the frame 84 is preferably constructed of a plastic material and/or a composite material such as glass-filled nylon, carbon-filled nylon or other composites or plastics that exhibit high strength and low weight. The frame 84 can additionally or alternatively be formed of an elastomeric material to surround the outer peripheral edge 110 located between the faces 88, 90 of the plate that forms the more rigid core 82. As with the core 82, the frame 84 includes upper mounting holes 112 and lower mounting holes 114 that extend through the thickness of the frame 84 between an outer side 116 and inner side 118 thereof. The upper mounting holes 112 and lower mounting holes 114 of the frame 84 are in alignment with the upper mounting holes 30 and lower mounting holes, respectively, of the core 82, for connecting the hybrid bracket assembly 12 to the riser of a bow (not shown) or other structure. Recesses 120 are also formed in the frame 84 coaxially with the upper and lower mounting holes 112 and 114, respectively, for receiving the heads 122 (FIG. 2) of the threaded fasteners 18.

The frame 84 also includes a pair of opposing jaws, as denoted by a frame upper jaw section 124 and a frame lower jaw section 126 that are molded over the core upper jaw section 106 and core lower jaw section 108, respectively. The frame upper and lower jaw sections are also separated by an adjustment slot 125 and an adjustment hole 127 that are formed in the frame 82 at a forward connection end 129 thereof during the forming or molding operation. The adjustment slot 125 and adjustment hole 127 intersect with each other so that the forward connecting end of the frame 84 has some flexibility in opposing directions to thereby allow movement between the frame jaw sections 124 and 126.

The frame upper jaw section 124 preferably includes an upper clamping surface 128 and the frame lower jaw section 126 preferably includes a lower clamping surface 130 that faces the upper clamping surface 126. The upper and lower clamping surfaces are complementary in shape with respect to the outer surfaces 132 of a windage arm 131 of the adjustment member 14 (see FIGS. 3 and 4), so that the windage arm 131, and thus the sight assembly 16, can be selectively adjusted in a horizontal or windage direction with respect to the riser of a bow (not shown) and fixed in place when the proper position has been achieved during calibration of the archery sight 10 with respect to the bow.

Figure 3:
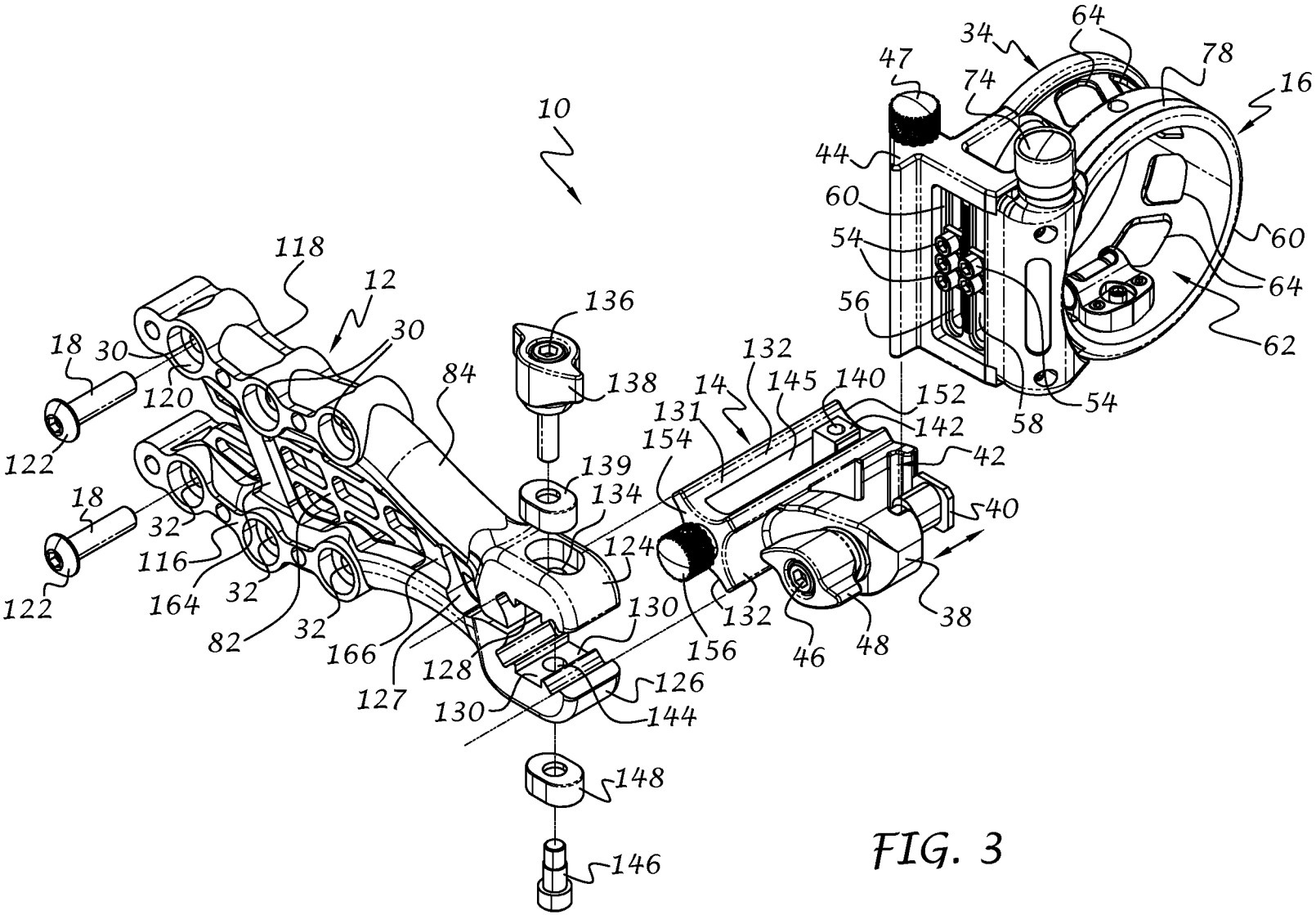
FIG. 3 is a partially exploded front right isometric view thereof.

As best shown in FIGS. 3 and 4, an upper opening 134 is formed in the frame upper jaw section 124. An upper fastener 136 extends through a windage knob 138, an upper spacer 139, and the upper opening 134, and threads into an upper threaded aperture 140 of a windage sleeve 142. The windage sleeve 142 is in turn positioned in a longitudinal slot 145 formed in the windage arm 130 for slidable movement therealong during micro-windage adjustment. Likewise, a lower opening 144 is formed in the frame lower jaw section 126. A lower fastener 146 extends through a lower spacer 148 and the lower opening 144, and threads into a corresponding lower threaded aperture (not shown) of the windage sleeve 142. The windage sleeve 142 also includes a transverse threaded aperture (not shown) that receives the threaded shaft (not shown) of a fastener 150. The fastener 150 extends through an outer wall 152 (FIG. 4) of the windage arm 130, spans the length of the windage arm 130 within the longitudinal slot 145, engages the threads of the transverse threaded aperture (not shown) of the windage sleeve 142, extends through an inner wall 154 of the windage arm 130, and threads into a micro-adjust windage knob 156.

In use, the windage knob 138 is rotated in one direction to loosen the core and frame jaw sections so that the windage arm 130 can be grasped and roughly slid to the desired position with respect to the hybrid bracket assembly 12. The knob 138 is then rotated in the opposite direction to move the jaw sections towards each other and hold the windage arm 130 under frictional forces. The micro-adjust windage knob 156 can then be rotated clockwise or counterclockwise to move the windage sleeve 142 along the longitudinal slot 45 of the windage arm 130, thereby moving the sight assembly 16 in a more precise manner for finely tuning the windage position.

In accordance with an exemplary method of constructing the hybrid bracket assembly 12, the core 82 can be formed using one of the methods previously described, then finished, which may include deburring, deflashing, anodizing, painting, coating, and so on. The core 82 is then placed into an injection mold, and a second material, such as described above, is over-molded around the core 82 to form the frame 84. In this manner, the two materials are permanently joined together, and work together to produce a sight bracket that is strong, light weight, and aesthetically pleasing to the purchaser or end user. Post processing of the combined two-part assembly can then be performed, such as tapping, masking, coating or the like. Preferably, retaining apertures or slots 160 (FIGS. 6 and 7) are formed in the core 82 and a corresponding number of retaining bumps 162 of corresponding shape and size are formed in rear upright supports 164 and front upright supports 166 of the frame 84 for engaging the retaining apertures 160 so that the core and frame are fixed together against relative slidable movement and the frame is more securely fixed to the core. Other retaining apertures 168 (FIGS. 6 and 7) of varying shapes and sizes can also be formed in the core 82 for receiving retaining bumps 170 (FIG. 7) of corresponding locations, shapes and sizes of the frame material. In accordance with the above-described exemplary method of construction, the retaining bumps 162, 170 are preferably formed when the frame 84 is over-molded around the core 82, with the material forming the retaining bumps flowing into the retaining apertures of the core. In this manner, the core 82 and frame 84 of the hybrid bracket assembly 12 function or perform as an integral structure.

In accordance with an exemplary embodiment of the invention, the plate material for the core 82 can be selected from the group of metals, ceramics, and composites, as well as combinations thereof, and the moldable material for the frame 84 can be selected from the group of plastics, thermoplastics, composites, and elastomers, as well as combinations thereof. However, it will be understood that other materials for the plate and frame components can be used without departing from the spirit and scope of the broader aspects of the invention.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. For example, although the hybrid bracket assembly is described herein as being primarily useful for mounting an archery sight assembly to a bow, it will be understood that the bracket assembly can be used for mounting other accessories to a bow without departing from the spirit and scope of the invention. Moreover, although the openings and retaining apertures in the core are shown as extending through the thickness of the plate, it will be understood that the openings and retaining apertures can be in the form of depressions or the like that do not extend entirely through the plate, and yet function to securely retain the frame on the core. In addition, although a particular number, configuration, and location of retaining apertures, holes, and retaining bumps have been described and shown, it will be understood that more or less holes and/or retaining apertures and corresponding retaining bumps can be provided in various configurations and locations. It will be understood, therefore, that the present invention is not limited to the particular embodiments disclosed, but also covers modifications within the spirit and scope of the invention as defined by the appended claim(s).

What is claimed is:

1. A hybrid bracket assembly for mounting an archery accessory to an archery bow, the hybrid bracket assembly comprising:

a core having a plurality of first holes for mounting the hybrid bracket to a riser of a bow; and a frame surrounding at least a portion of an outer peripheral edge of the core and overlapping an area of the core coincident with the plurality of first holes, the frame having a plurality of corresponding second holes that are coincident with the first holes;

wherein the core and frame have different material properties.

2. A hybrid bracket assembly according to claim 1, wherein the frame surrounds at least a substantial portion of the outer peripheral edge of the core.

3. A hybrid bracket assembly according to claim 2, wherein:

the core comprises a plate constructed of a material having a first stiffness with a first side and an opposing second side; and the frame comprises a moldable material with a second stiffness less than the first stiffness, the moldable material overlapping portions of the first and second sides of the plate.

4. A hybrid bracket assembly according to claim 3, wherein the frame further comprises:

a first pair of opposing jaw sections being movable toward and away from each other for receiving and frictionally engaging a windage arm associated with the archery sight.

5. A hybrid bracket assembly according to claim 4, wherein the first pair of opposing jaw sections are located forwardly of the plate.

6. A hybrid bracket assembly according to claim 5, wherein the core further comprises:

a second pair of opposing jaw sections defined by an adjustment slot and an adjustment hole extending through a thickness of the plate at a forward connection end thereof, the slot and hole intersecting with each other to create flexibility of the second pair of opposing jaw sections.

7. A hybrid bracket assembly according to claim 6, and further comprising at least one retaining aperture formed in the plate and at least one corresponding retaining bump formed in the frame for engaging the at least one retaining aperture so that the core and frame function as an integral structure.

8. A hybrid bracket assembly according to claim 7, wherein the at least one retaining bump is formed during molding of the frame onto the plate.

9. A hybrid bracket assembly according to claim 8, wherein the plate material comprises a material selected from the group of metals, ceramics, and composites, and the moldable material comprises at least one material selected from the group of plastics, thermoplastics, composites, and elastomers.

10. A hybrid bracket assembly according to claim 3, and further comprising at least one retaining aperture formed in the core and at least one corresponding retaining bump formed in the frame for engaging the at least one retaining aperture so that the core and frame function as an integral structure.

11. A hybrid bracket assembly for mounting an archery accessory to an archery bow, the hybrid bracket assembly comprising:

a core including a plate constructed of a material having a first stiffness, the plate having a first side, an opposing second side, and a peripheral edge located between the first and second sides, and at least one set of mounting holes extending through a thickness of the plate for mounting the hybrid bracket assembly to the archery bow; and a frame including a moldable material with a second stiffness, the moldable material extending around at least a segment of the peripheral edge and overlapping an area of the first and second sides of the plate;

having a plurality of first holes for mounting the hybrid bracket to a riser of a bow; and a frame surrounding and at least a portion of an outer peripheral edge of the plate.

12. A hybrid bracket assembly according to claim 11, wherein the frame overlaps portions of the first and second sides of the plate.

13. A hybrid bracket assembly according to claim 12, wherein the frame further comprises:

a first pair of opposing jaw sections being movable toward and away from each other for receiving and frictionally engaging a windage arm associated with the archery sight.

14. A hybrid bracket assembly according to claim 13, wherein the first pair of opposing jaw sections are located forwardly of the plate.

15. A bowsight comprising the hybrid bracket assembly of claim 13, and further comprising:

a sight assembly having at least one sight pin for aligning with a distal target by a user during aiming;

an adjustment member connected to the sight assembly, the adjustment member and sight assembly having cooperating structure for selectively adjusting an elevation position of the sight assembly with respect to the hybrid bracket assembly, the adjustment member further having a windage arm connected to the first pair of opposing jaw sections, the windage arm being selectively adjustable with respect to the hybrid bracket assembly for selectively adjusting a windage position of the sight assembly.

16. A hybrid bracket assembly according to claim 11, wherein the plate material comprises at least one material selected from the group of metals, ceramics, and composites, and the moldable material comprises at least one material selected from the group of plastics, thermoplastics, composites, and elastomers.

17. A hybrid bracket assembly according to claim 11, and further comprising at least one retaining aperture formed in the plate and at least one corresponding retaining bump formed in the frame for engaging the at least one retaining aperture so that the core and frame function as an integral structure.

18. A bowsight comprising the hybrid bracket assembly of claim 1, and further comprising:

a sight assembly having at least one sight pin for aligning with a distal target by a user during aiming;

an adjustment member connected to the sight assembly, the adjustment member and sight assembly having first cooperating structure for selectively adjusting an elevation position of the sight assembly with respect to the hybrid bracket assembly, the adjustment member and the hybrid bracket assembly having second cooperating structure for selectively adjusting a windage position of the sight assembly with respect to the hybrid bracket assembly.

19. A method of forming a hybrid bracket assembly for mounting an archery accessory to an archery bow, the method comprising:

providing a core with a first material having a first stiffness;

forming a first set of openings in the core for mounting the hybrid bracket to a riser of a bow;

forming at least one retaining aperture in the core;

forming a frame around at least a portion of a peripheral edge of the core, the frame having a second material with a second stiffness lower than the first stiffness; and extruding material from the frame into the at least one retaining aperture while forming the frame to thereby create at least one retaining bump in the frame so that the core and the frame function as an integral structure.

20. The method according to claim 19, wherein:

the step of providing a core comprises providing a plate having a first side, an opposing second side with the peripheral edge located between the first and second sides; and the step of forming a frame including molding the second material around at least a substantial portion of the peripheral edge and overlapping an area of the first and second sides of the plate so that the core and the frame function as an integral structure.

* * * * *